US012419376B2

(12) United States Patent
Kyababchyan et al.

(10) Patent No.: US 12,419,376 B2
(45) Date of Patent: Sep. 23, 2025

(54) PROTECTIVE EQUIPMENT ASSEMBLY AND METHOD OF USE

(71) Applicants: Serob Kyababchyan, Van Nuys, CA (US); Amy Kyababchyan, Van Nuys, CA (US)

(72) Inventors: Serob Kyababchyan, Van Nuys, CA (US); Amy Kyababchyan, Van Nuys, CA (US)

( * ) Notice: Subject to any disclaimer, the term of this patent is extended or adjusted under 35 U.S.C. 154(b) by 264 days.

(21) Appl. No.: 18/122,005

(22) Filed: Mar. 15, 2023

(65) Prior Publication Data

US 2024/0306831 A1 Sep. 19, 2024

(51) Int. Cl.
*A42B 3/04* (2006.01)

(52) U.S. Cl.
CPC ..... *A42B 3/0473* (2013.01)

(58) Field of Classification Search
CPC .. A41D 13/0512; A42B 3/0473; A42B 3/125; A42B 3/14; A63B 71/10; A63B 71/12; A63B 71/1291; A63B 2243/007
USPC ..... 2/410, 416, 421, 422, 425
See application file for complete search history.

(56) References Cited

U.S. PATENT DOCUMENTS 3,134,106 A * 5/1964 Shaffer ..... A63B 71/1291 2/468
3,879,761 A * 4/1975 Bothwell ..... A42B 3/06 2/415
3,900,896 A * 8/1975 Ackerman ..... A63B 71/1291 2/468
5,581,816 A * 12/1996 Davis ..... A63B 71/10 2/416
5,715,541 A * 2/1998 Landau ..... A41D 13/05 2/410
6,006,368 A * 12/1999 Phillips ..... A42B 3/0473 2/468
6,874,170 B1 * 4/2005 Aaron ..... A63B 71/1291 2/468
6,968,576 B2 11/2005 Mcneil
D522,178 S 5/2006 Ashline
8,561,217 B2 10/2013 Nagely
9,861,152 B1 * 1/2018 Rumfelt ..... A63B 71/12
9,867,413 B2 1/2018 Blecherman
(Continued)

FOREIGN PATENT DOCUMENTS

CA 2460937 4/2004

OTHER PUBLICATIONS https://www.gettyimages.com/detail/photo/caucasian-boy-in-football-uniform-royalty-free-image/142020072 (Year: 2012).*

*Primary Examiner* — Shaun R Hurley

(57) ABSTRACT

A protective equipment assembly for reducing concussive forces and risk of chronic traumatic encephalopathy includes shoulder pads, a helmet, and a bracing element. The bracing element is attached to and extends from one of the helmet and the shoulder pads and is selectively attachable to the other of the helmet and the shoulder pads. The helmet thus is substantially fixedly positioned relative to the shoulder pads. Padding is attached to an inner surface of the helmet and define an interior space that is larger than a head of the user, thereby allowing the user to rotate and to pivot their head. The bracing element limits motion of the helmet relative to the shoulder pads upon application of a force to the helmet or to the shoulder pads while the padding reduce forces applied to the head and a neck.

6 Claims, 7 Drawing Sheets

(56) References Cited

U.S. PATENT DOCUMENTS

| | | | | |
|---|---|---|---|---|
| 10,188,311 | B2 | 1/2019 | Huang | |
| 11,272,751 | B2 * | 3/2022 | Popejoy | A42B 3/08 |
| 11,382,369 | B2 * | 7/2022 | Hampton | A63B 71/12 |
| 11,583,025 | B2 * | 2/2023 | Peace, III | A42B 3/142 |
| 2002/0174480 | A1 * | 11/2002 | Lombard | A42B 3/20 2/424 |
| 2006/0096010 | A1 * | 5/2006 | Glaser | A42B 3/0473 2/421 |
| 2013/0031706 | A1 | 2/2013 | Cooksey | |
| 2014/0020161 | A1 * | 1/2014 | Mason | A63B 71/12 2/463 |
| 2017/0035137 | A1 * | 2/2017 | Blecherman | A42B 3/0473 |
| 2017/0188647 | A1 * | 7/2017 | Blecherman | A42B 1/08 |
| 2017/0290386 | A1 * | 10/2017 | Murray | A41D 13/0512 |
| 2019/0054363 | A1 * | 2/2019 | Metts | C08G 77/38 |
| 2019/0344152 | A1 * | 11/2019 | Popejoy | A63B 71/12 |
| 2020/0128900 | A1 * | 4/2020 | Trevillion | A42B 3/0473 |

* cited by examiner

PROTECTIVE EQUIPMENT ASSEMBLY AND METHOD OF USE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to protective equipment and more particularly pertains to new protective equipment for reducing concussive forces and risk of chronic traumatic encephalopathy. The present invention discloses protective equipment that substantially fixedly positions a helmet relative to shoulder pads and which allows a user to rotate and pivot their head within the helmet.

(2) Description of Related Art Including Information Disclosed Under 37 CFR 1.97 and 1.98

The prior art relates to protective equipment, which may comprise helmets and shoulder pads connected by shock absorbing elements or struts, with the latter being incompressible longitudinally but laterally deformable. What is lacking in the prior art is protective equipment comprising a rigid bracing element connecting a helmet to shoulder pads, and in particular a bracing element comprising two selectively attachable plates, with one plate extending from each of the helmet and the shoulder pads.

BRIEF SUMMARY OF THE INVENTION

An embodiment of the disclosure meets the needs presented above by generally comprising shoulder pads, a helmet, and a bracing element. The shoulder pads and the helmet are configured to be donned by a user and attached to a chest and to a head of the user, respectively. An opening, which is positioned in the helmet, is configured to enable viewing by the user. The bracing element is attached to and extends from one of the helmet and the shoulder pads and is selectively attachable to the other of the helmet and the shoulder pads. The helmet thus is substantially fixedly positioned relative to the shoulder pads. Padding, which is attached to an inner surface of the helmet, defines an interior space that is larger than a head of the user. The interior space is configured to allow for rotation and pivoting of the head of the user. The bracing element is configured to limit motion of the helmet relative to the shoulder pads upon application of a force to the helmet or to the shoulder pads. The padding is configured to reduce forces applied to the head and a neck of the user that result from the force to the helmet or to the shoulder pads.

Another embodiment of the disclosure includes a method of protecting a head and a neck of a user. The method comprises a provision step, which entails providing a protective equipment assembly, according to the disclosure above. Preparatory steps are donning the shoulder pads, donning the helmet, and attaching the second fastener to the first fastener. Use steps of the method are participating in a contact sport and allowing the bracing element to limit motion of the helmet and the padding to reduce forces applied to the head and the neck.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
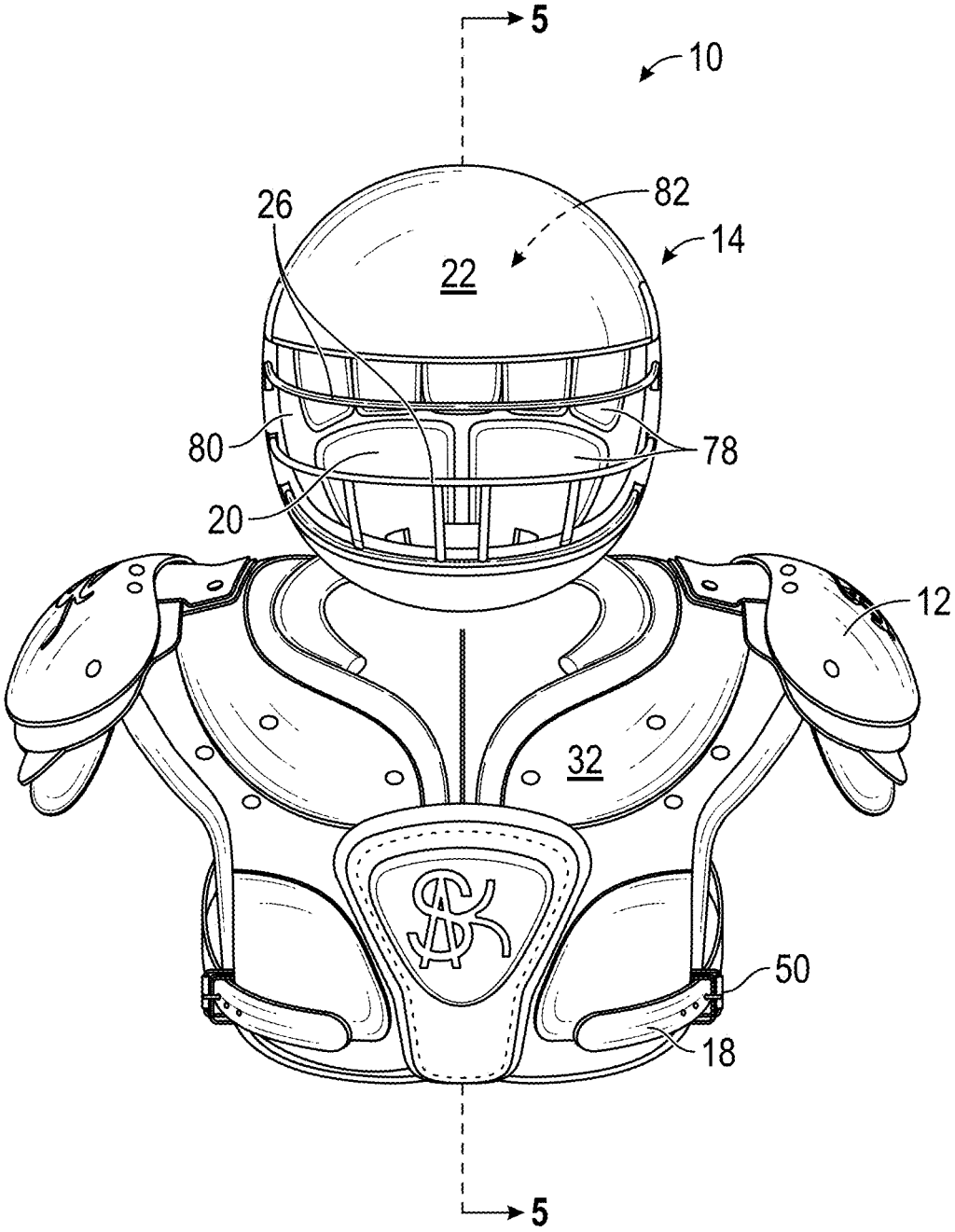
FIG. 1 is a front view of a protective equipment assembly according to an embodiment of the disclosure.

With reference now to the drawings, and in particular to FIGS. 1 through 7 thereof, a new protective equipment embodying the principles and concepts of an embodiment of the disclosure and generally designated by the reference numeral 10 will be described.

As best illustrated in FIGS. 1 through 7, the protective equipment assembly 10 generally comprises shoulder pads 12, a helmet 14, and a bracing element 16. The shoulder pads 12 and the helmet 14 are configured to be donned by a user and attached to a chest and to a head of the user, respectively. The shoulder pads 12 may be securable to the user by means of a strap 18 having buckles 50, as shown in FIG. 1, or other fastening means, such as, but not limited to, hook and loop fasteners, snap closures, or the like.

Figure 5:
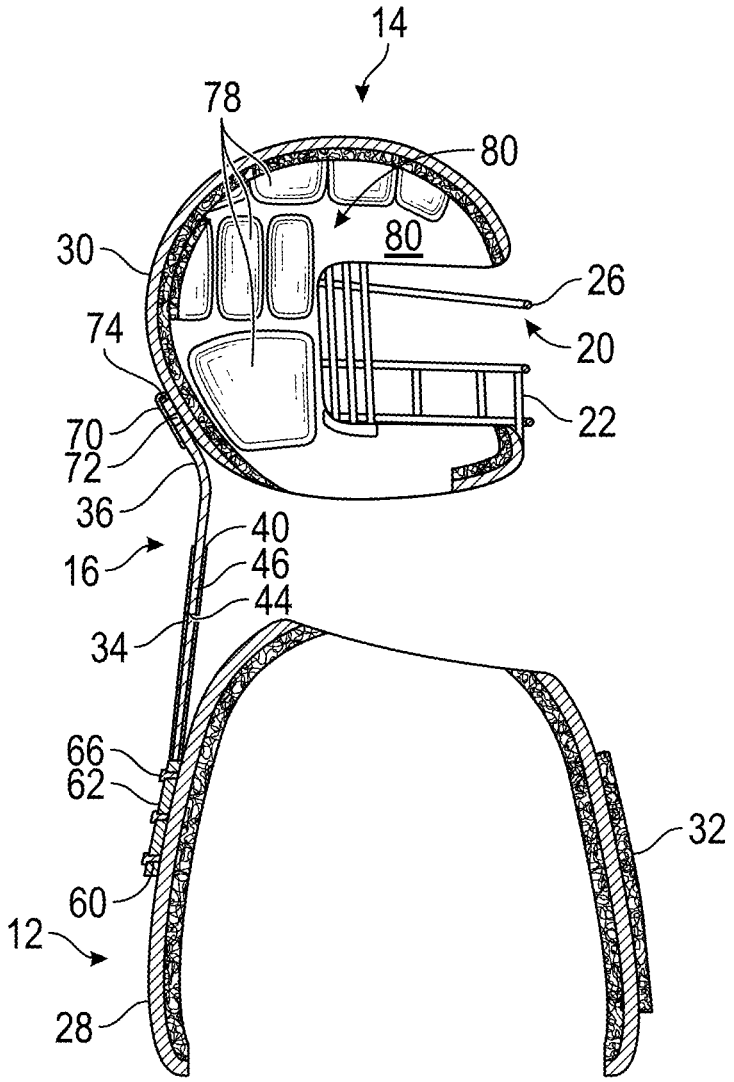
FIG. 5 is a cross-sectional view of an embodiment of the disclosure.
Figure 6:
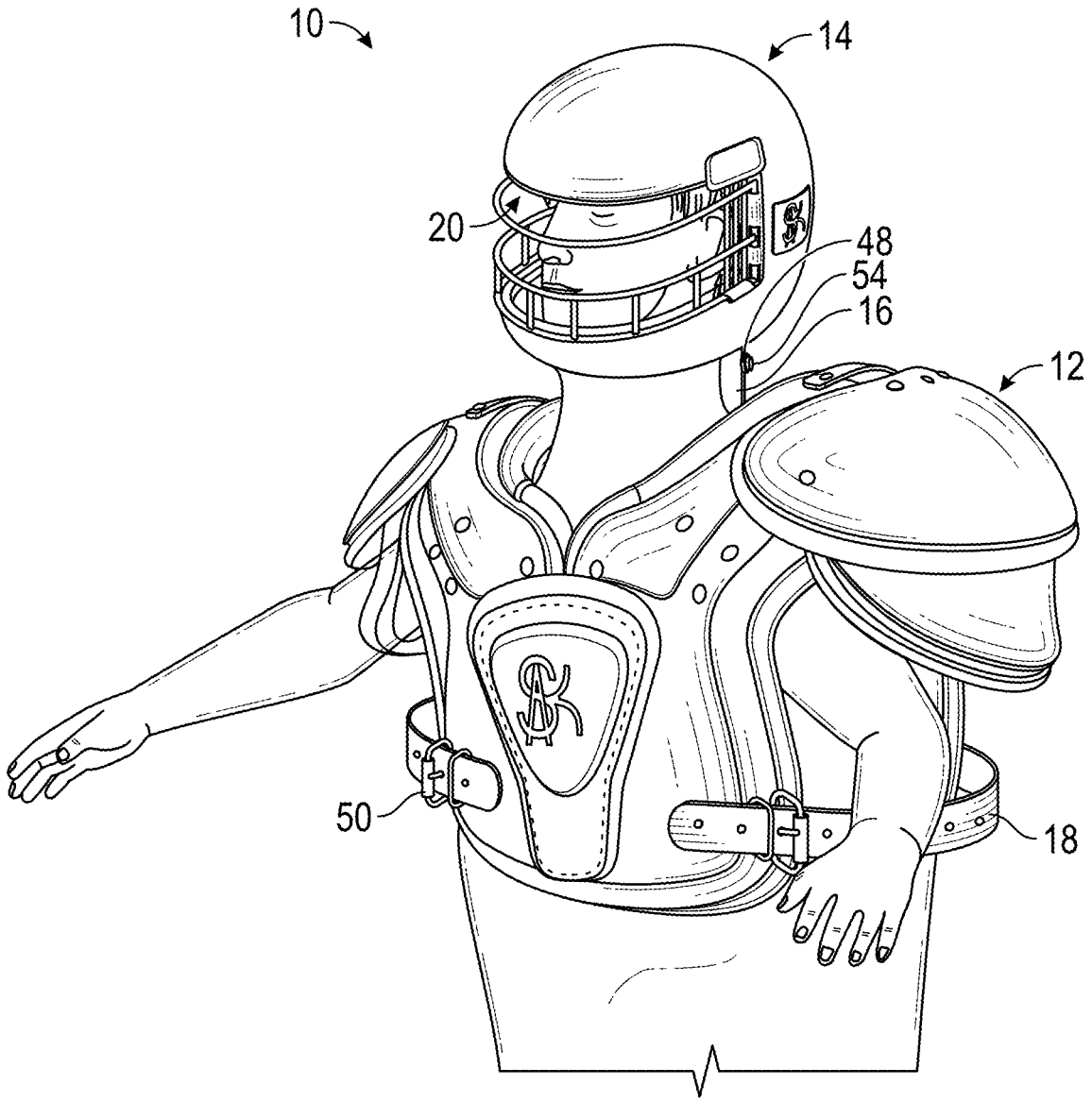
FIG. 6 is an in-use view of an embodiment of the disclosure.
Figure 7:
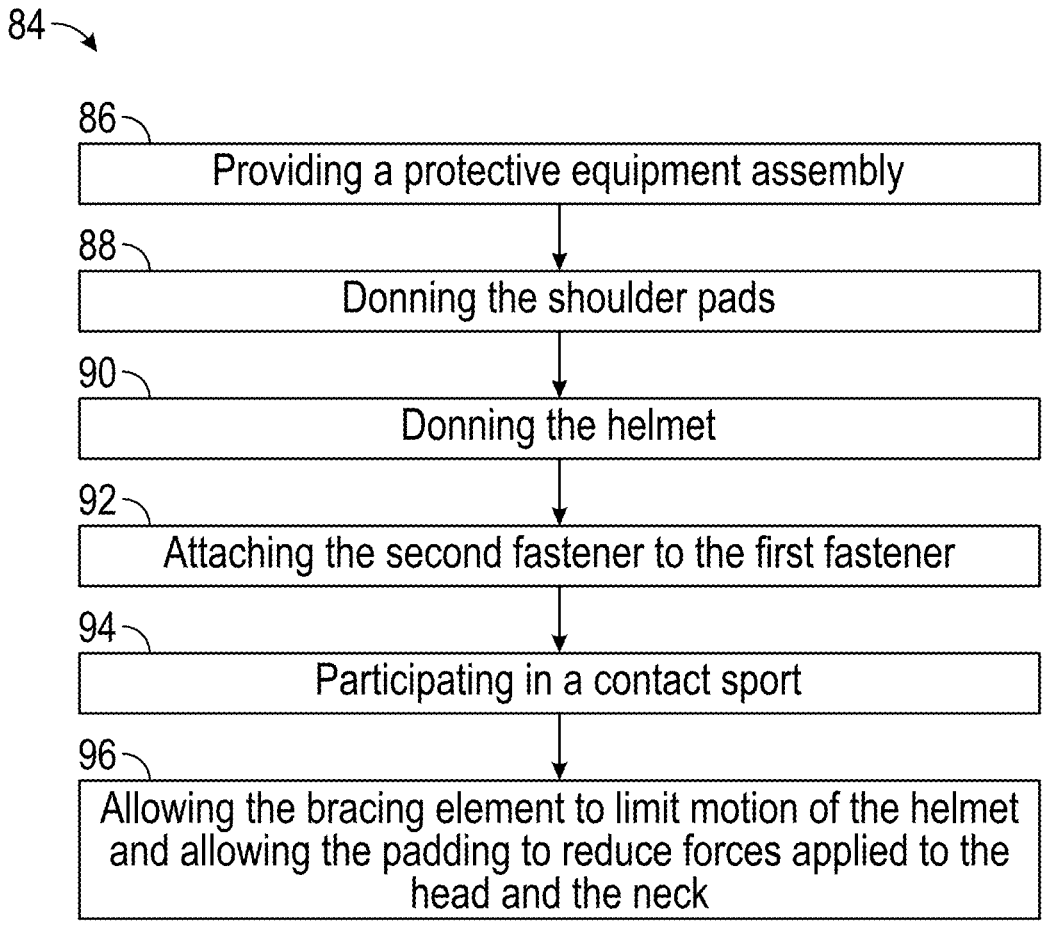
FIG. 7 is a flow diagram for a method utilizing an embodiment of the disclosure.

An opening 20, which is positioned in the helmet 14, is configured to enable viewing by the user. As shown in FIGS. 5 and 6, the opening 20 extends across a front face 22 of the helmet 14 into opposed faces 24 of the helmet 14. The opening 20 is configured to enable a field of view of from 120° to 185°. A face mask 26 is attached to the helmet 14 and extends over the opening 20. A wide variety of face masking means are present in the prior art and these are anticipated by the present invention. The present invention also anticipates the protective equipment assembly 10 comprising a chin strap, a visor or face shield, communications equipment, and the like.

As shown in FIG. 5, the bracing element 16 is attached to and extends from one of the helmet 14 and the shoulder pads 12 and is selectively attachable to the other of the helmet 14 and the shoulder pads 12. The helmet 14 thus is substantially fixedly positioned relative to the shoulder pads 12. As shown in FIGS. 1-6, a single bracing element 16 is attached to and extends between a rear facet 28 of the shoulder pads 12 and a rear face 30 of the helmet 14. The present invention also anticipates another bracing element 16 being attached to and extending between a front facet 32 of the shoulder pads 12 and the front face 22 of the helmet 14.

Figure 4:
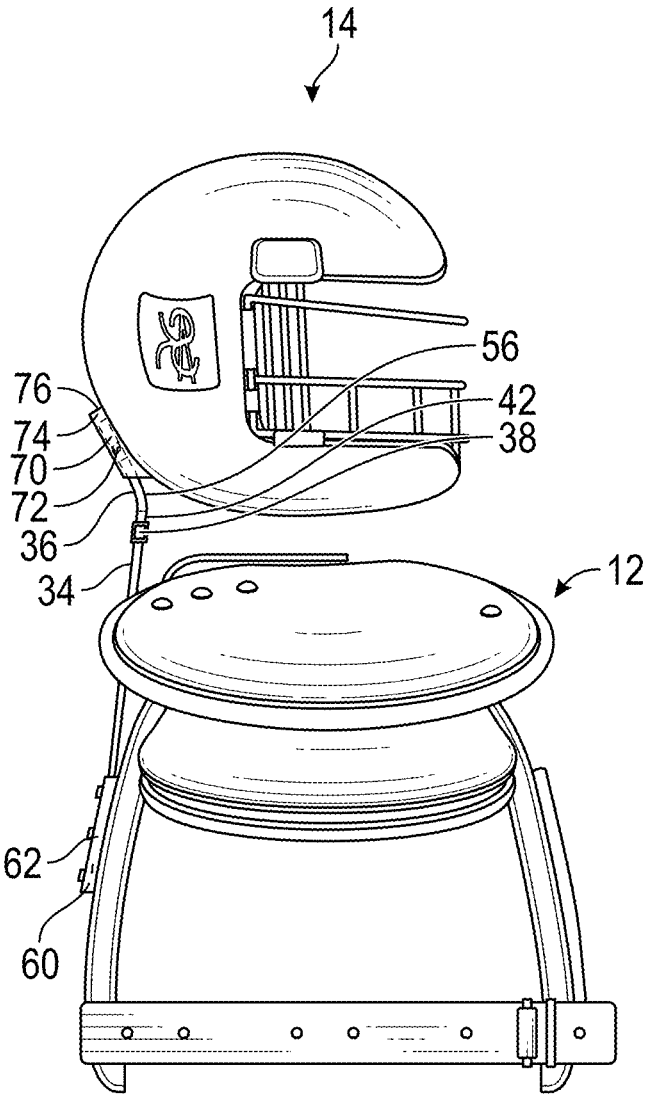
FIG. 4 is a side view of an embodiment of the disclosure.

The bracing element 16 may comprise a first plate 34 and a second plate 36. The first plate 34 is attached by its lower end 60 to and extends upwardly from the rear facet 28 of the shoulder pads 12. The second plate 36 is attached by its upper limit 74 to and extends downwardly from the rear face 30 of the helmet 14. As shown in FIG. 4, the second plate 36 is arcuate, thereby allowing it to reach the rear face 30 of the helmet 14. A first fastener 38 is attached to the first plate 34 proximate to its upper end 40 and a second fastener 42 is attached to the second plate 36 proximate to its lower limit 44. The second fastener 42 is complementary to the first fastener 38 and thus is positioned to selectively fasten to the first fastener 38 to removably attach the second plate 36 to the first plate 34.

Figure 2:
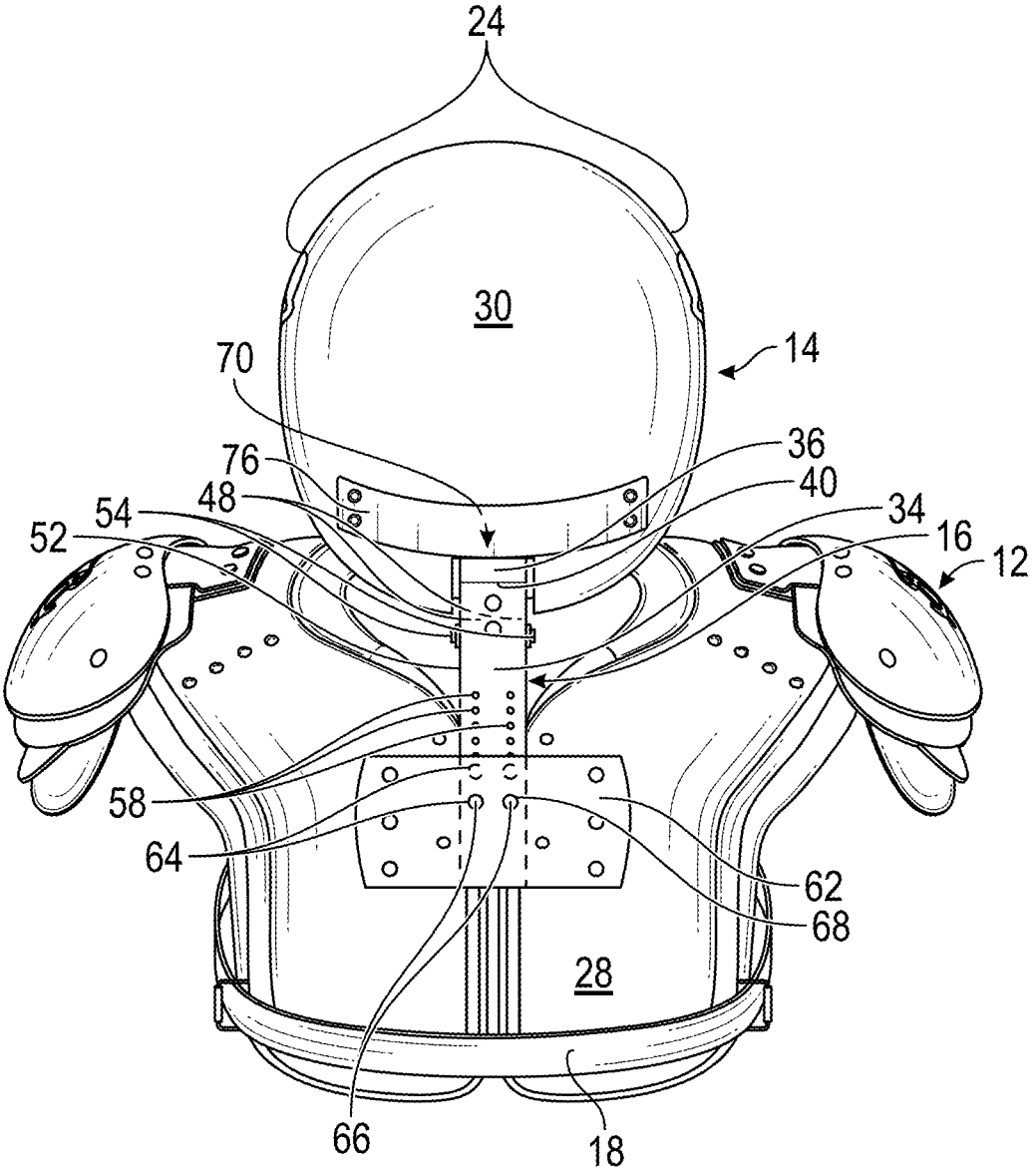
FIG. 2 is a rear view of an embodiment of the disclosure.
Figure 3:
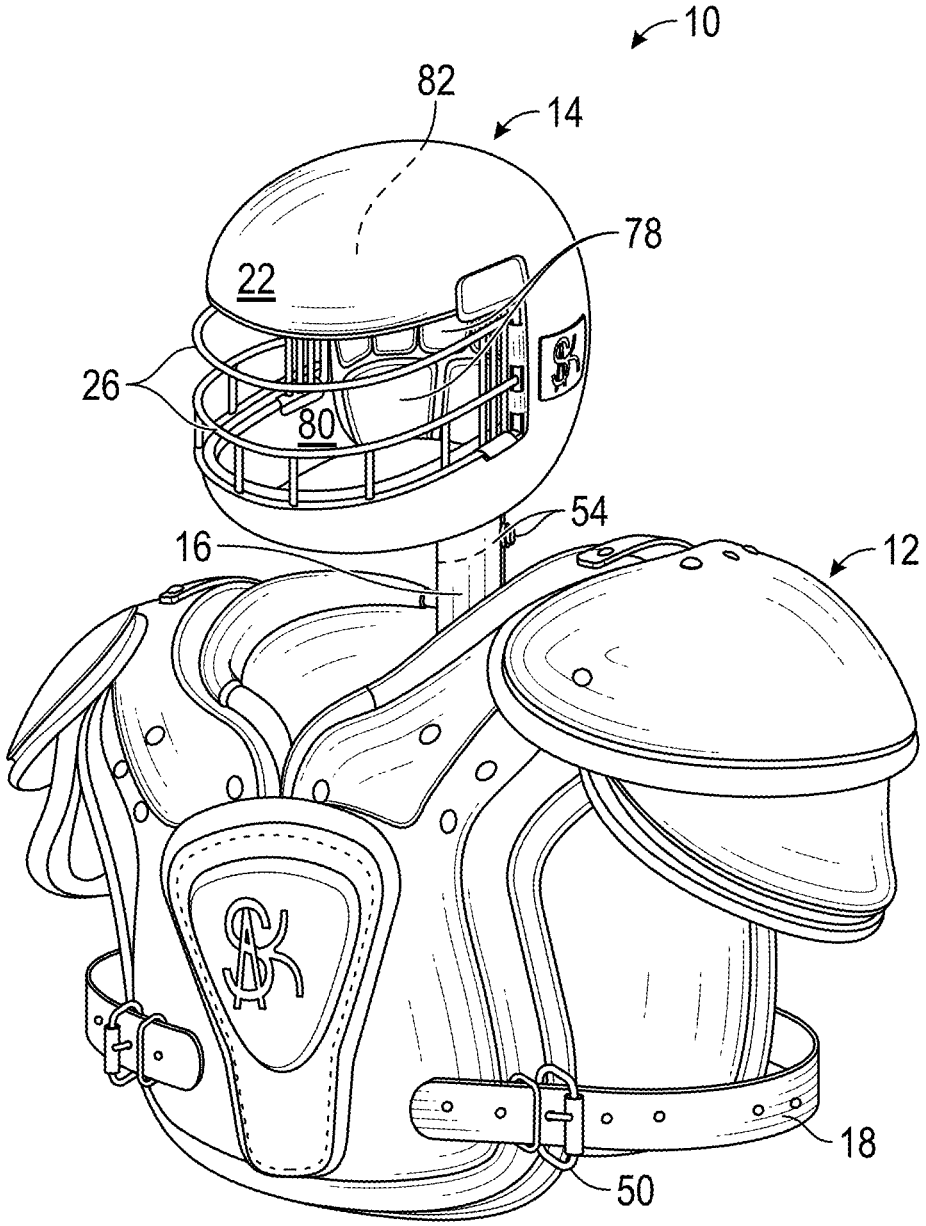
FIG. 3 is an isometric perspective view of an embodiment of the disclosure.

As shown in FIGS. 2-3, the first fastener 38 comprises a slot 46, which extends into the upper end 40 of the first plate 34, and a pair of holes 48. Each hole 48 is positioned in a respective opposed side 52 of the first plate 34 and opens into the slot 46. The second fastener 42 comprises a pair of pins 54, the pins 54 of which are spring loaded. Each pin 54 is attached to and extends from a respective opposed edge 56 of the second plate 36 and is positioned for selective insertion into a respective hole 48 upon partial insertion of the second plate 36 into the slot 46. The helmet 14 can be removed selectively by pushing the pins 54 into the holes 48.

As shown in FIG. 2, a plurality of first apertures 58 is positioned in the first plate 34 and extends from proximate to a lower end 60 the first plate 34 toward the upper end 40 of the first plate 34. A back plate 62 is attached to the rear facet 28 of the shoulder pads 12. The first plate 34 is selectively insertable between the back plate 62 and the rear facet 28 of the shoulder pads 12. A plurality of second apertures 64 is positioned in the back plate 62. Respective first apertures 58 are selectively alignable with respective second apertures 64, positioning the respective first apertures 58 and the respective second apertures 64 for insertion of mounting hardware 66, such as bolts 68, to fixedly attach the first plate 34 to the back plate 62. The back plate 62 is positioned to resist rotation of the first plate 34 relative to the shoulder pads 12.

A bracket 70 is attached to the rear face 30 of the helmet 14 and a segment 72 of the second plate 36, which is adjacent to its upper limit 74, is attached to the bracket 70. An arcuate plate 76 is attached to and extends bilaterally from the bracket 70. The arcuate plate 76 is attached to the rear face 30 of the helmet 14 and thus is positioned to resist rotation of the helmet 14 relative to the second plate 36.

Padding 78, which is attached to an inner surface 80 of the helmet 14, defines an interior space 82 that is larger than a head of the user. The interior space 82 is configured to allow for rotation and pivoting of the head of the user. The bracing element 16 is configured to limit motion of the helmet 14 relative to the shoulder pads 12 upon application of a force to the helmet 14 or to the shoulder pads 12. The padding 78 is configured to reduce forces applied to the head and a neck of the user that result from the force to the helmet 14 or to the shoulder pads 12. The present invention is anticipated to be useful in reducing concussive forces to the head of the user while the user is participating in contact sports, such as, but not limited to, American football, Canadian football, arena football, or the like. The cumulative effect of multiple concussions can lead to Chronic Traumatic Encephalopathy (CTE) and associate morbidities, such as behavioral problems, mood problems, problems with thinking, and dementia.

In use, the protective equipment assembly 10 enables a method of protecting a head and a neck of a user 84. The method 84 comprises a provision step 86, which entails providing a protective equipment assembly 10, according to the specification above. A first preparatory step 88 of the method 84 is donning the shoulder pads 12. A second preparatory step 90 of the method 84 is donning the helmet 14. A third preparatory step 92 of the method 84 is attaching the second fastener 42 to the first fastener 38. A first use step 94 of the method 84 is participating in a contact sport. The interior space 82 allows the user to rotate and pivot their head while participating in the contact sport. This, combined with the opening 20 being larger than prior art headgear, ensures that the user has a sufficient field of view. A second use step 96 of the method 84 is allowing the bracing element 16 to limit motion of the helmet 14 relative to the shoulder pads 12 upon application of a force to the helmet 14 or to the shoulder pads 12 and allowing the padding 78 to reduce forces applied to the head and the neck of the user resulting from the force to the helmet 14 or to the shoulder pads 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A protective equipment assembly comprising:

shoulder pads configured for donning by a user and attachment to a chest of the user;

a helmet configured for donning by the user and attachment to a head of the user;

an opening positioned in the helmet, wherein the opening is configured to enable viewing by the user;

a bracing element attached to and extending from one of the helmet and the shoulder pads, the bracing element being selectively attachable to the other of the helmet and the shoulder pads, such that the helmet is substantially fixedly positioned relative to the shoulder pads;

padding attached to an inner surface of the helmet, such that the padding defines an interior space larger than a head of the user, wherein the interior space is configured for allowing rotation and pivoting of the head of the user, wherein the bracing element is configured for limiting motion of the helmet relative to the shoulder pads upon application of a force to the helmet or to the shoulder pads, and wherein the padding is configured for reducing forces applied to the head and a neck of the user resulting from the force to the helmet or to the shoulder pads;

a face mask attached to the helmet and extending over the opening;

wherein the bracing element comprises a first plate attached by a lower end to and extending upwardly from a rear facet of the shoulder pads, a first fastener attached to the first plate proximate to an upper end of the first plate, a second plate attached by an upper limit to and extending downwardly from a rear face of the helmet, and a second fastener attached to the second plate proximate to a lower limit of the second plate, the second fastener being complementary to the first fastener, such that the second fastener is positioned for selectively fastening to the first fastener for removably attaching the second plate to the first plate;

a plurality of first apertures positioned in the first plate and extending from proximate to the lower end toward the upper end of the first plate;

a back plate attached to the rear facet of the shoulder pads, the first plate being selectively insertable between the back plate and the rear facet of the shoulder pads; and a plurality of second apertures positioned in the back plate, such that respective first apertures of the plurality of first apertures are selectively alignable with respective second apertures of the plurality of second apertures, positioning the respective first apertures of the plurality of first apertures and the respective second apertures of the plurality of second apertures for insertion of mounting hardware for fixedly attaching the first plate to the back plate, such that the back plate is positioned to resist rotation of the first plate relative to the shoulder pads.

2. The protective equipment assembly of claim 1, wherein the opening extends across a front face of the helmet into opposed faces of the helmet, wherein the opening is configured to enable a field of view of from 120° to 185°.

3. The protective equipment assembly of claim 1, further including:

a bracket attached to the rear face of the helmet, a segment of the second plate adjacent to the upper limit being attached to the bracket; and an arcuate plate attached to and extending bilaterally from the bracket, the arcuate plate being attached to the rear face of the helmet, such that the arcuate plate is positioned for resisting rotation of the helmet relative to the second plate.

4. The protective equipment assembly of claim 1, further comprising:

the opening extending across a front face of the helmet into opposed faces of the helmet, wherein the opening is configured to enable a field of view of from 120° to 185°;

the bracing element comprising:

the first fastener comprising:

a slot extending into the upper end of the first plate, and a pair of holes, each hole of the pair of holes being positioned in a respective opposed side of the first plate and opening into the slot, a bracket attached to the rear face of the helmet, a segment of the second plate adjacent to the upper limit being attached to the bracket, an arcuate plate attached to and extending bilaterally from the bracket, the arcuate plate being attached to the rear face of the helmet, such that the arcuate plate is positioned for resisting rotation of the helmet relative to the second plate, and the second fastener comprising a pair of pins, the pins of the pair of pins being spring loaded, each pin of the pair of pins being attached to and extending from a respective opposed edge of the second plate, such that the pin is positioned for selective insertion into a respective hole of the pair of holes upon partial insertion of the second plate into the slot.

5. A protective equipment assembly comprising:

shoulder pads configured for donning by a user and attachment to a chest of the user;

a helmet configured for donning by the user and attachment to a head of the user;

an opening positioned in the helmet, wherein the opening is configured to enable viewing by the user;

a bracing element attached to and extending from one of the helmet and the shoulder pads, the bracing element being selectively attachable to the other of the helmet and the shoulder pads, such that the helmet is substantially fixedly positioned relative to the shoulder pads;

padding attached to an inner surface of the helmet, such that the padding defines an interior space larger than a head of the user, wherein the interior space is configured for allowing rotation and pivoting of the head of the user, wherein the bracing element is configured for limiting motion of the helmet relative to the shoulder pads upon application of a force to the helmet or to the shoulder pads, and wherein the padding is configured for reducing forces applied to the head and a neck of the user resulting from the force to the helmet or to the shoulder pads;

a face mask attached to the helmet and extending over the opening;

wherein the bracing element comprises a first plate attached by a lower end to and extending upwardly from a rear facet of the shoulder pads, a first fastener attached to the first plate proximate to an upper end of the first plate, a second plate attached by an upper limit to and extending downwardly from a rear face of the helmet, and a second fastener attached to the second plate proximate to a lower limit of the second plate, the second fastener being complementary to the first fastener, such that the second fastener is positioned for selectively fastening to the first fastener for removably attaching the second plate to the first plate;

wherein the first fastener comprises:

a slot extending into the upper end of the first plate, and a pair of holes, each hole of the pair of holes being positioned in a respective opposed side of the first plate and opening into the slot; and wherein the second fastener comprises a pair of pins, the pins of the pair of pins being spring loaded, each pin of the pair of pins being attached to and extending from a respective opposed edge of the second plate, such that the pin is positioned for selective insertion into a respective hole of the pair of holes upon partial insertion of the second plate into the slot.

6. A method of protecting a head and a neck of a user comprising the steps of:

providing a protective equipment assembly comprising:

shoulder pads configured for donning by a user and attachment to a chest of the user, a helmet configured for donning by the user and attachment to a head of the user, an opening positioned in the helmet, wherein the opening is configured to enable viewing by the user, a bracing element attached to and extending from one of the helmet and the shoulder pads, the bracing element being selectively attachable to the other of the helmet and the shoulder pads, such that the helmet is substantially fixedly positioned relative to the shoulder pads, the bracing element comprising:

a first plate attached by a lower end to and extending upwardly from a rear facet of the shoulder pads, a first fastener attached to the first plate proximate to an upper end of the first plate, a second plate attached by an upper limit to and extending downwardly from a rear face of the helmet, and a second fastener attached to the second plate proximate to a lower limit of the second plate, the second fastener being complementary to the first fastener, such that the second fastener is positioned for selectively fastening to the first fastener for removably attaching the second plate to the first plate, and padding attached to an inner surface of the helmet, such that the padding defines an interior space larger than a head of the user, wherein the interior space is configured for allowing rotation and pivoting of the head of the user;

donning the shoulder pads;

donning the helmet;

attaching the second fastener to the first fastener;

participating in a contact sport; and allowing the bracing element to limit motion of the helmet relative to the shoulder pads upon application of a force to the helmet or to the shoulder pads and allowing the padding to reduce forces applied to the head and the neck of the user resulting from the force to the helmet or to the shoulder pads.

* * * * *